United States Patent [19]

Sorimachi et al.

[11] Patent Number: 4,945,975

[45] Date of Patent: Aug. 7, 1990

[54] METHOD OF OSCILLATION OF MOLD OF VERTICAL CONTINUOUS CASTER

[75] Inventors: Kenichi Sorimachi; Hirokazu Tozawa; Tetsuya Fujii; Seiji Itoyama; Yuji Miki, all of Chiba, Japan

[73] Assignee: Kawasaki Steel Corporation, Kobe, Japan

[21] Appl. No.: 444,318

[22] Filed: Nov. 30, 1989

[30] Foreign Application Priority Data

Dec. 8, 1988 [JP] Japan ..... 63-308780
Feb. 3, 1989 [JP] Japan ..... 1-23806

[51] Int. Cl.[5] ..... B22D 11/04
[52] U.S. Cl. ..... 164/478; 164/416
[58] Field of Search ..... 164/478, 416

[56] References Cited

U.S. PATENT DOCUMENTS 3,494,411 2/1970 Reihman ..... 164/478

*Primary Examiner*—Kuang Y. Lin
*Attorney, Agent, or Firm*—Balogh, Osann, Kramer, Dvorak, Genova & Traub

[57] ABSTRACT

A method of oscillating a mold of a vertical continuous caster of the type having a pair of longer side frames and a pair of shorter side frames. The mold is oscillated vertically during the casting. A pair of mold walls, e.g., the longer side frames, are moved towards and away from the cast metal in synchronization with a vertical oscillation of the mold, so as to control the condition for supplying a mold powder into the gap between the mold walls and the cast metal.

12 Claims, 6 Drawing Sheets

METHOD OF OSCILLATION OF MOLD OF VERTICAL CONTINUOUS CASTER

BACKGROUND OF THE INVENTION

1. Field of the Invention

The present invention relates to a continuous metal casting process and, more particularly, to a method of oscillating a mold of a vertical continuous caster for the purpose of production of a cast metal which is free of breakout, oscillation marks and other defects.

2. Description of the Related Art

In general, when metal is being cast in a continuous vertical caster, the mold is vertically oscillated while a mold powder is supplied to the melt in the mold so as to reduce friction between the mold surface and the solidified shell of the metal. The effect of the mold powder is closely related to the condition of oscillation of the mold, and it is necessary that the condition of oscillation is suitably controlled such that the mold powder is introduced at a proper rate into the boundary between the mold and the solidified shell.

The oscillation of the mold is usually effected such that the velocity Vm of oscillation of the mold follows a specific sine waveform, as for example, as shown in FIG. 3. It has also been proposed to oscillate the mold in accordance with a modified sine waveform as disclosed in Japanese Laid-Open Patent application No. 60-87955.

On the other hand, U.S. Pat. No. 3,494,411 discloses a method in which a longitudinally split open-ended water cooled mold is used, wherein the mold is oscillated not only in the longitudinal direction which parallels to the casting direction but also in a transverse direction perpendicular to the casting direction.

This method, however, cannot allow control of the rate of supply of the mold powder in accordance with the casting conditions, because the longitudinal and transverse oscillations are effected independently.

SUMMARY OF THE INVENTION

Accordingly, the objects of the present invention are as follows:

1. To enable the rate of supply of a mold flux to be controlled in accordance with the type of the material to be cast;

2. To decrease the casting defect by controlling the rate of supply of the mold flux;

3. More practically, to eliminate breakout of the cast metal and to prevent generation of oscillation mark on the surface of the cast metal; and 4. To increase the casting speed.

To these ends, according to the present invention, there is provided a method of oscillating a mold of a vertical continuous caster having a pair of longer side frames and a pair of shorter side frames, the method comprising: moving a pair of mold walls towards and away from the cast metal in synchronization with a vertical oscillation of the mold, so as to control the condition for supplying a mold powder into the gap between the mold walls and the cast metal.

The above and other objects, features and advantages of the present invention will become clear from the following description of the preferred embodiments when the same is read in conjunction with the accompanying drawings.

DESCRIPTION OF THE PREFERRED EMBODIMENT

Figure 1:
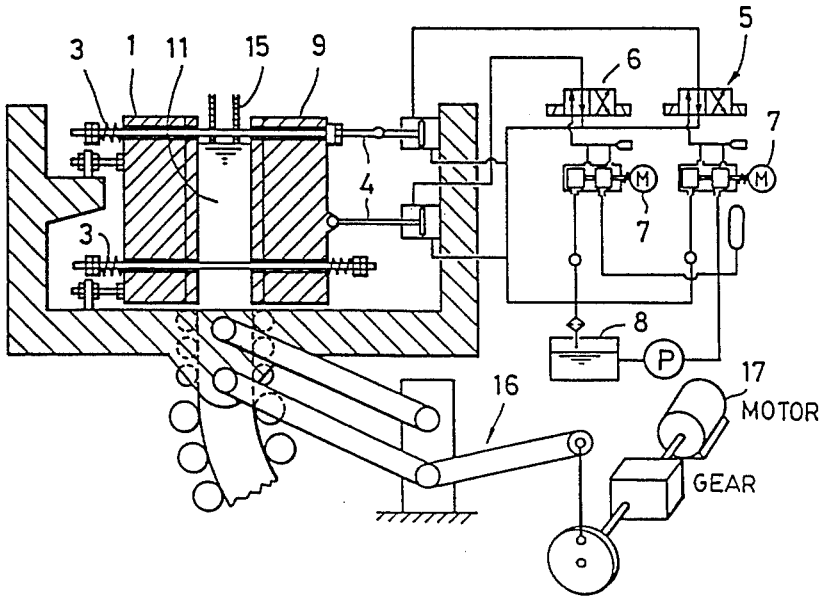
FIG. 1 is a side elevational view of an apparatus suitable for use in carrying out the method of the present invention.
Figure 2:
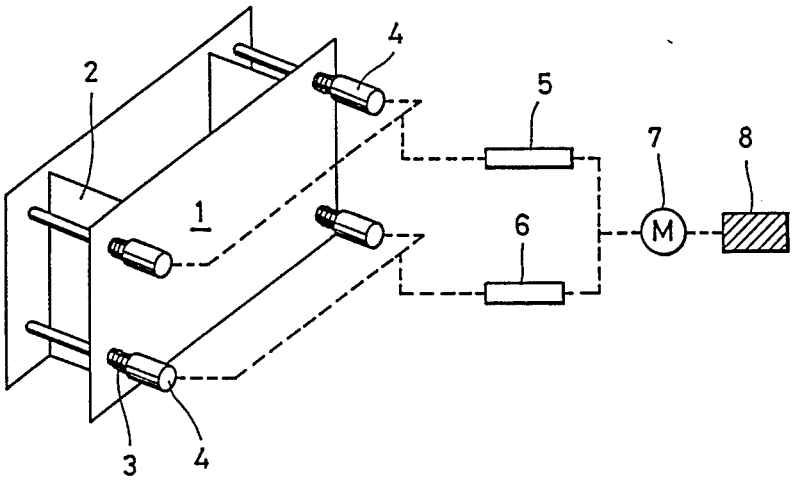
FIG. 2 is a block diagram of the apparatus shown in FIG. 1.

FIG. 1 is a side elevational view of an apparatus suitable for use in carrying out the method of the present invention, while FIG. 2 is a block diagram of the apparatus shown in FIG. 1. The apparatus has a pair of longer side frames 1 and a pair of shorter side frames 2. The longer side frames 1 are clamped by longer side frame clamp springs 3. One of the longer side frames 1 is capable of being moved towards and away from the other by the force produced by longer side frame operation cylinders 4. The longer side frame operation cylinders 4 are driven by pressurized fluid supplied from a hydraulic motor 7, through a mold upper part operation solenoid valve 5 and a mold lower part operation solenoid valve 6. A tank 8 stores the hydraulic fluid.

The longer and shorter side frames 1 and 2 in cooperatively form a mold 9 into which a melt, e.g., a molten steel 11, is poured through an immersed nozzle 15. The mold 9 is oscillated up and down by a vertical oscillation device 16 which is powered by a motor 17.

Figure 3:
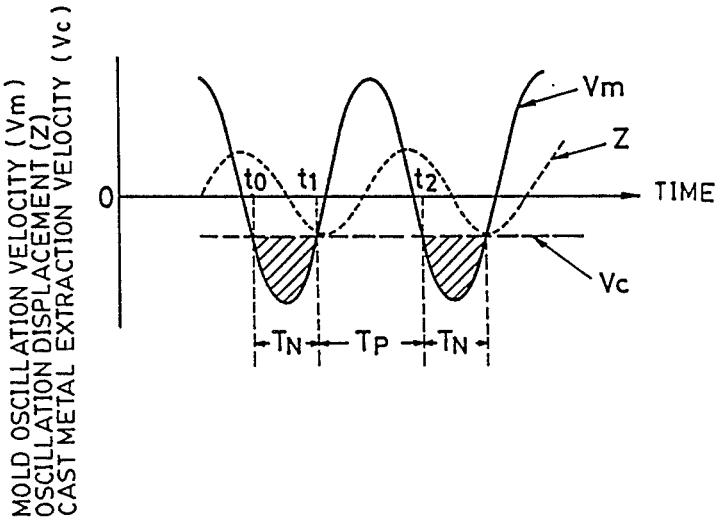
FIG. 3 is a graph showing the manner in which the velocity of oscillation of a vertical mold and the velocity of extraction of the cast metal are changed in relation to time.

The oscillating method of the present invention will be described with reference to FIG. 3. As a result of the vertical oscillation, the vertical position of the mold 9 varies in accordance with a curve Z of sine waveform. A curve Vm shows the velocity of the vertical oscillation at each of the vertical positions of the mold. When the mold reaches the upper end of its stroke, the velocity Vm is reduced to zero. The velocity Vm is then progressively increased and then decreased again so as to become zero when the mold reaches the lower end of the oscillation stroke. The velocity Vm then starts to increase again as the mold starts to move upward. In a period Tp, the velocity Vm of oscillation of the mold is lower than the velocity Vc of extraction of the cast metal. This period Tp will be referred to as "positive strip period". In a period $T_n$, the velocity Vm of the mold is higher than the velocity Vc of extraction of the cast metal. This period $T_n$ will be referred to as the "negative strip period".

a. Prevention of breakout

According to the present invention, the breakout of the cast metal is effectively prevented as follows.

Figure 4:
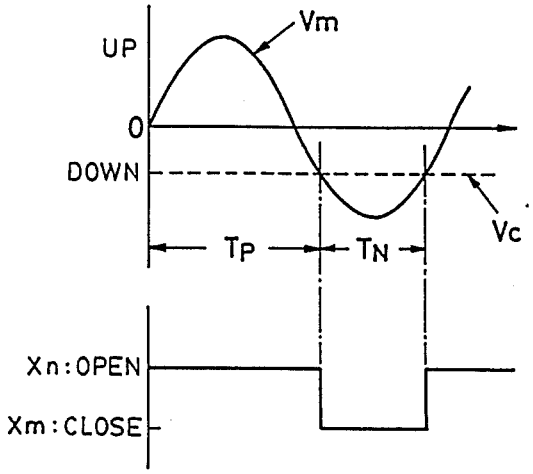
FIGS. 4(*a*) to 4(*f*) are graphs showing the waveform of oscillation of the vertical mold and timing of movement of the mold toward and away from the cast steel.
Figure 4:
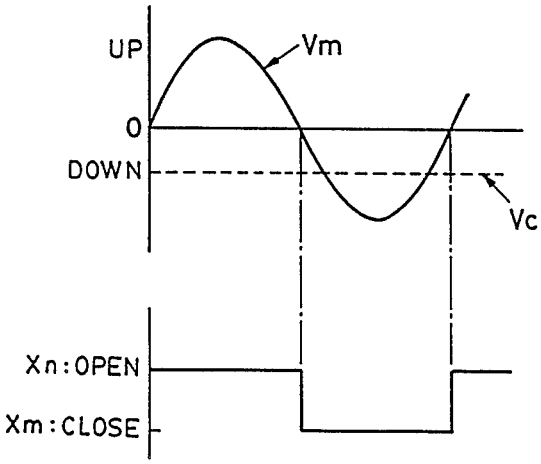
Figure 4:
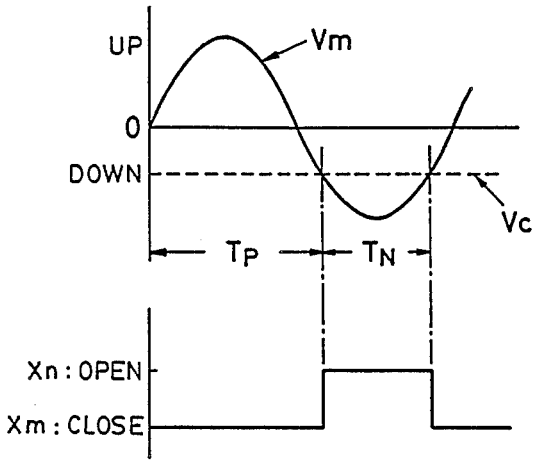
Figure 4:
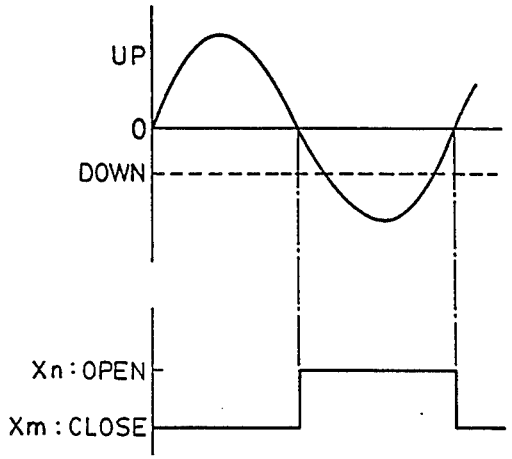
Figure 4:
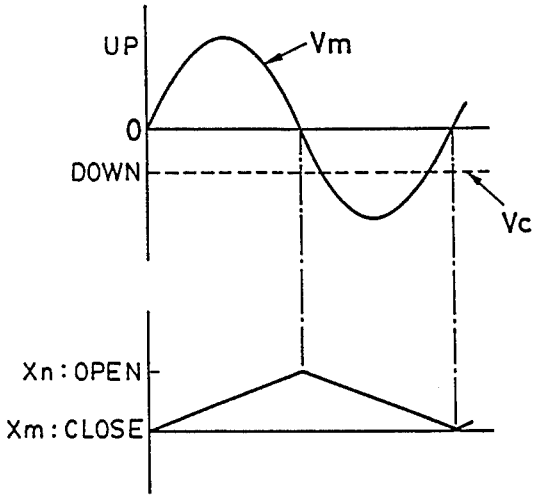
Figure 4:
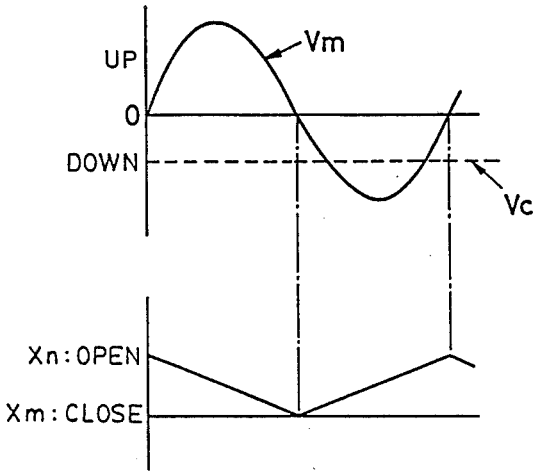
Figure 5:
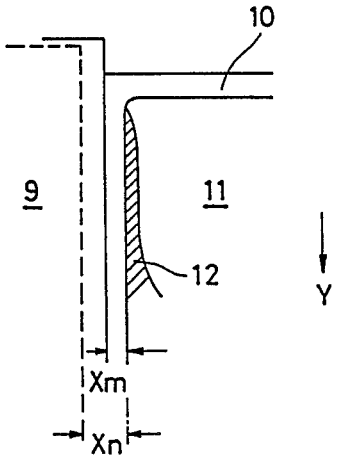
FIG. 5 is a schematic illustration of the boundary between the mold surface and a solidified shell.

As shown in FIG. 4(*a*), a pair of mold walls, e.g., the longer side frames, of the vertical continuous caster mold are retracted away from the cast metal, during the positive strip period of the vertical oscillation so as to increase the clearance between the mold wall and the solidified shell 12 thereby to allow a sufficiently large amount of mold powder 10 to flow into the gap between the mold wall and the solidified shell so as to reduce the friction between the mold wall and the solidified shell, thereby preventing adhesion of the solidified shell to the mold wall surface. Thus, the mold walls are reciprocatingly moved in the direction perpendicular to the direction of extraction such that the clearance Xm (see FIG. 5) between the mold wall and the solidified shell is increased to Xn during the positive strip period of the vertical oscillation, whereas, in the negative strip period, the mold walls are moved again towards the solidified shell so as to recover the original clearance Xm.

In general, a continuous slab caster is so constructed that the shorter side frames 2 are clamped between the longer side frames 1 as shown in FIG. 2. According to the invention, therefore, the above-described movement of the mold walls is effected by moving one of the longer side frames 1 by means of hydraulic cylinders 4 which are suitably controlled by the hydraulic circuit. If overly large clearances are formed between the longer side frames and the shorter side frames, the molten steel undesirably flows into the gaps often resulting in troubles such as casting failure. Therefore, the amount of retraction of each mold wall, represented by (Xn−Xm), is preferably not greater than 1.0 mm. On the other hand, the frictional force acting between the mold wall and the solidified shell can be inferred as the shearing force acting on the mold powder between the mold and the solidified shell. The shearing force is represented by the following formula.

$$F = A\mu \frac{dv}{dx} \quad (1)$$

where,

A: area of contact between the mold and the solidified shell;

$\mu$: Viscosity of powder introduced into the gap between the mold and the solidified shell;

v: relative velocity between mold surface and solidified shell; and x: distance between mold and solidified shell It will be understood that the frictional force F is maximized when the mold is moving upward at the maximum velocity (within positive strip period). According to the invention, the distance x between the mold wall and the solidified shell is increased during the positive strip period in which the frictional force would be maximized if the distance x were constant. Since the frictional force F is in inverse proportion to the distance x, it is possible to prevent undesirable increase in the frictional force F, by changing the distance x, thereby suppressing occurrence of restraint breakout which tends to occur particularly during the high-speed casting.

A similar effect can be obtained by increasing the distance between the mold and the solidified shell by rapidly or progressively retracting the mold walls during upward phase of the vertical oscillation of the mold so as to supply a sufficiently large amount of mold powder, as shown in FIGS. 4(*b*) and 4(*e*).

b. Prevention of oscillation mark

According to the invention, it is possible to suppress generation of oscillation mark as will be understood from the following description.

As shown in FIG. 4(*c*), the mold walls of a vertical continuous caster mold are retracted away from the solidified shell, so as to increase the distance therebetween during the negative strip period of the vertical oscillation of the mold, so that a large amount of mold powder is supplied into the gap between the mold, and the solidified shell so as to reduce the frictional force acting between the mold surface and the solidified shell, thereby reducing the amount of bend at the end of the solidified shell. Thus, the mold walls of the vertical continuous caster mold are reciprocatingly moved in a direction perpendicular to the direction of extraction of the cast metal such that the mold walls are moved away from the solidified shell. This increases the clearance Xm (see FIG. 5) to Xn during the negative strip period of the vertical oscillation of the mold. In the positive strip period, the mold walls are again moved towards the solidified shell so as to recover the original distance Xm.

A similar effect can be obtained by increasing the distance between the mold and the solidified shell by rapidly or progressively retracting the mold during downward phase of the vertical oscillation of the mold so as to supply sufficiently large amount of mold powder, as shown in FIGS. 4(*d*) and 4(*f*).

Figure 6:
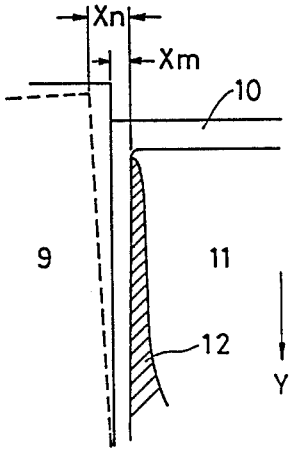
FIG. 6 is a schematic illustration of a state in which the upper portion of the mold is oscillated about a fulcrum provided at the lower side of the mold towards and away from the cast metal.

The movement of the mold wall, e.g., the longer side frame, for changing the distance between the mold wall and the solidified shell may be effected by simultaneously operating the hydraulic cylinders 4 acting on the upper and lower portions of the longer side frame 1 so that the frame 1 is translationally moved towards and away from the solidified shell. This, however, is only illustrative and the invention may be carried out so that only the upper portion of the frame is moved by hydraulic cylinders towards and away from the solidified shell. Here the frame 1 pivots about a point assumed on a lower portion of the caster, so as to change the distance at the upper end portion of the mold, as shown in FIGS. 1 and 6.

EXAMPLE 1

A slab was cast by a vertical continuous casting mold while the mold was oscillated in the following manner. A pair of mold walls are moved away from the cast metal so as to increase the distance between the mold walls and the cast metal in the positive strip period of the vertical oscillation of the mold. In the negative strip period of the vertical oscillation of the mold, the pair of mold walls are moved towards the cast metal so as to decrease the distance. The rate of supply of the mold powder into the clearance between the mold and the solidified shell and the state of occurrence of breakout were observed. The results are shown in Table 1 in comparison with the results of a similar test conducted by oscillating the mold by a conventional method which employs oscillation following a sine waveform. As will be seen from this Table, the method of the present invention can remarkably decrease the occurrence of breakout.

EXAMPLE 2

TABLE 1

| | Mold oscillating condition | | Amount | Casting | Powder supply | Breakout |
|---|---|---|---|---|---|---|
| | Amp. (mm) | Freq. (cpm) | of mold retract | velocity (m/min) | rate ($kg/m^2$) | occurrence rate |
| Conventional method | 6 | 140 | 0 | 1.8 | 0.30 | 1.0 (reference) |
| Invention | 6 | 140 | 0.2 | 1.8 | 0.40 | 0.3 |
| Conventional method | 6 | 30 | 0 | 1.8 | 0.20 | 15.7 |
| Invention | 6 | 30 | 0.3 | 1.8 | 0.35 | 0.5 |

Note:
Type of steel used: SUS 304 steel Viscosity of mold powder used 1.5 poise at 1300° C.

Figure 7:
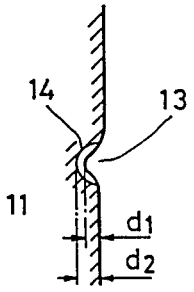
FIG. 7 is a schematic illustration of an oscillation mark and a segregation layer.

A slab was cast by a vertical continuous casting mold while the mold was oscillated in the following manner. A pair of mold walls are moved towards the cast metal so as to decrease the distance between the mold walls and the cast metal in the positive strip period of the vertical oscillation of the mold. In the negative strip period of the vertical oscillation of the mold, the pair of mold walls are moved away the cast metal so as to increase the distance. The depth $d_1$ of oscillation mark 13 and the depth $d_2$ (see FIG. 7) of segregation 14 were observed. The results are shown in Table 2 in comparison with the results of a similar test conducted by oscillating the mold by a conventional method which employs oscillation following a sine waveform. As will be seen from this Table, the method of the present invention can remarkably decrease the depths of oscillation mark and segregation.

TABLE 2

| | Mold oscillating condition | | Amount | Casting | Oscillate mark | Segregation |
|---|---|---|---|---|---|---|
| | Amp. (mm) | Freq. (cpm) | of mold retract | velocity (mm/min) | depth ($d_1$: mm) | depth ($d_2$: mm) |
| Conventional method | 3 | 180 | 0 | 0.7 | 0.62 | 0.7 |
| Invention | 3 | 180 | 0.2 | 0.7 | 0.25 | 0.30 |
| Conventional method | 3 | 30 | 0 | 0.7 | 0.40 | 0.55 |
| Invention | 3 | 30 | 0.2 | 0.7 | 0.15 | 0.20 |

Note:
Type of steel used: SUS 304 steel Viscosity of mold powder used 1.5 poise at 1300° C.

As will be understood from the foregoing description, the present invention enables a control of the rate of supply of a mold powder into the boundary between the mold wall and the solidified shell of the cast metal, thus making it possible to suppress occurrence of breakout and generation of oscillation mark on the cast product.

What is claimed is:

1. A method of oscillating a mold of a vertical continuous caster having a pair of longer side frames and a pair of shorter side frames, said method comprising: moving a pair of mold walls towards and away from the cast metal in synchronization with a vertical oscillation of said mold, so as to control the condition for supplying a mold powder into the gap between said mold walls and said cast metal.

2. A method according to claim 1, wherein said pair of mold walls are moved away from said cast metal so as to increase the distance between said mold walls and said cast metal in the upward phase of the vertical oscillation of said mold, whereas, in the downward phase of the vertical oscillation of said mold, said pair of mold walls are moved towards said cast metal so as to decrease said distance.

3. A method according to claim 1, wherein said pair of mold walls are moved away from said cast metal so as to increase the distance between said mold walls and said cast metal in the positive strip period of the vertical oscillation of said mold, whereas, in the negative strip period the vertical oscillation of said mold, said pair of mold walls are moved towards said cast metal so as to decrease said distance.

4. A method according to claim 1, wherein said pair of mold walls are moved towards said cast metal so as to decrease the distance between said mold walls and said cast metal in the upward phase of the vertical oscillation of said mold, whereas, in the downward phase of the vertical oscillation of said mold, said pair of mold walls are moved away from said cast metal so as to increase said distance.

5. A method according to claim 1, wherein said pair of mold walls are moved towards said cast metal so as to decrease the distance between said mold walls and said cast metal in the positive strip period of the vertical oscillation of said mold, whereas, in the negative strip period the vertical oscillation of said mold, said pair of mold walls are moved away from said cast metal so as to increase said distance.

6. A method according to claim 1, wherein, in the upward phase of the vertical oscillation of said mold, said pair of mold walls are progressively moved away from said cast metal so that the distance between said mold walls and said cast metal is maximized when said mold has reached the upper end of the stroke of the vertical oscillation, whereas, in the downward phase of the vertical oscillation of said mold, said pair of mold walls are progressively moved towards said cast metal so that said distance is minimized when said mold has reached the lower end of the stroke of the vertical oscillation.

7. A method according to claim 1, wherein in the upward phase of the vertical oscillation of said mold, said pair of mold walls are progressively moved towards said cast metal so that the distance between said mold walls and said cast metal is minimized when said mold has reached the upper end of the stroke of the vertical oscillation, whereas, in the downward phase of the vertical oscillation of said mold, said pair of mold walls are progressively moved away from said cast metal so that said distance is maximized when said mold has reached the lower end of the stroke of the vertical oscillation.

8. A method according to claim 2, wherein said movement of said pair of mold walls is conducted by causing said mold walls to pivot about a fulcrum assumed on the lower side of said mold so that the upper end portions of said mold walls move towards and away from said cast metal.

9. A method according to claim 3, wherein said movement of said pair of mold walls is conducted by causing said mold walls to pivot about a fulcrum assumed on the lower side of said mold so that the upper end portions of said mold walls move towards and away from said cast metal.

10. A method according to claim 4, wherein said movement of said pair of mold walls is conducted by causing said mold walls to pivot about a fulcrum assumed on the lower side of said mold so that the upper end portions of said mold walls move towards and away from said cast metal.

11. A method according to claim 5, wherein said movement of said pair of mold walls is conducted by causing said mold walls to pivot about a fulcrum assumed on the lower side of said mold so that the upper end portions of said mold walls move towards and away from said cast metal.

12. A method according to claim 6, wherein said movement of said pair of mold walls is conducted by causing said mold walls to pivot about a fulcrum assumed on the lower side of said mold so that the upper end portions of said mold walls move towards and away from said cast metal.

* * * * *